United States Patent [19]

Durham, Jr.

[11] Patent Number: 4,753,055

[45] Date of Patent: Jun. 28, 1988

[54] HEADWALL UNIT FOR HOSPITAL ROOMS AND THE LIKE

[75] Inventor: Ira M. Durham, Jr., Houston, Tex.

[73] Assignee: The Methodist Hospital System, Houston, Tex.

[21] Appl. No.: 897,832

[22] Filed: Aug. 18, 1986

[51] Int. Cl.[4] ..... A47B 83/00; A61G 7/06

[52] U.S. Cl. ..... 52/28; 5/2; 52/36; 52/173 R; 174/70 R

[58] Field of Search ..... 52/28, 36, 173; 174/48, 174/70 R; 312/209, 238; 5/2; 362/85

[56] References Cited

U.S. PATENT DOCUMENTS

| | | | |
|---|---|---|---|
| 3,338,650 | 8/1967 | Ryan | 312/209 |
| 3,451,738 | 6/1969 | Hobson | 312/209 |
| 3,660,591 | 5/1972 | Schultz | 174/70 R |
| 3,794,395 | 2/1974 | Damico et al. | 312/209 |
| 3,921,345 | 11/1975 | Damico | 52/28 |
| 4,177,612 | 12/1979 | Tochihara | 52/28 |
| 4,338,485 | 7/1982 | Fullenkamp et al. | 174/48 |
| 4,354,330 | 10/1982 | Schwartz | 52/28 |
| 4,360,991 | 11/1982 | West | 52/36 X |

*Primary Examiner*—J. Karl Bell

*Attorney, Agent, or Firm*—Vinson & Elkins

[57] ABSTRACT

A headwall unit (10) adapted to be attached to a vertically extending wall (W) of a hospital room. The headwall unit (10) has a pair of side portions (12, 14) spaced to receive the end of a bed therebetween. Each side portion (12, 14) has an intermediate compartment (46) and an outer slidable panel (58) exposing a lower inset panel (56) having a plurality of outlets (57A–57D) thereon when raised to an open position.

15 Claims, 2 Drawing Sheets

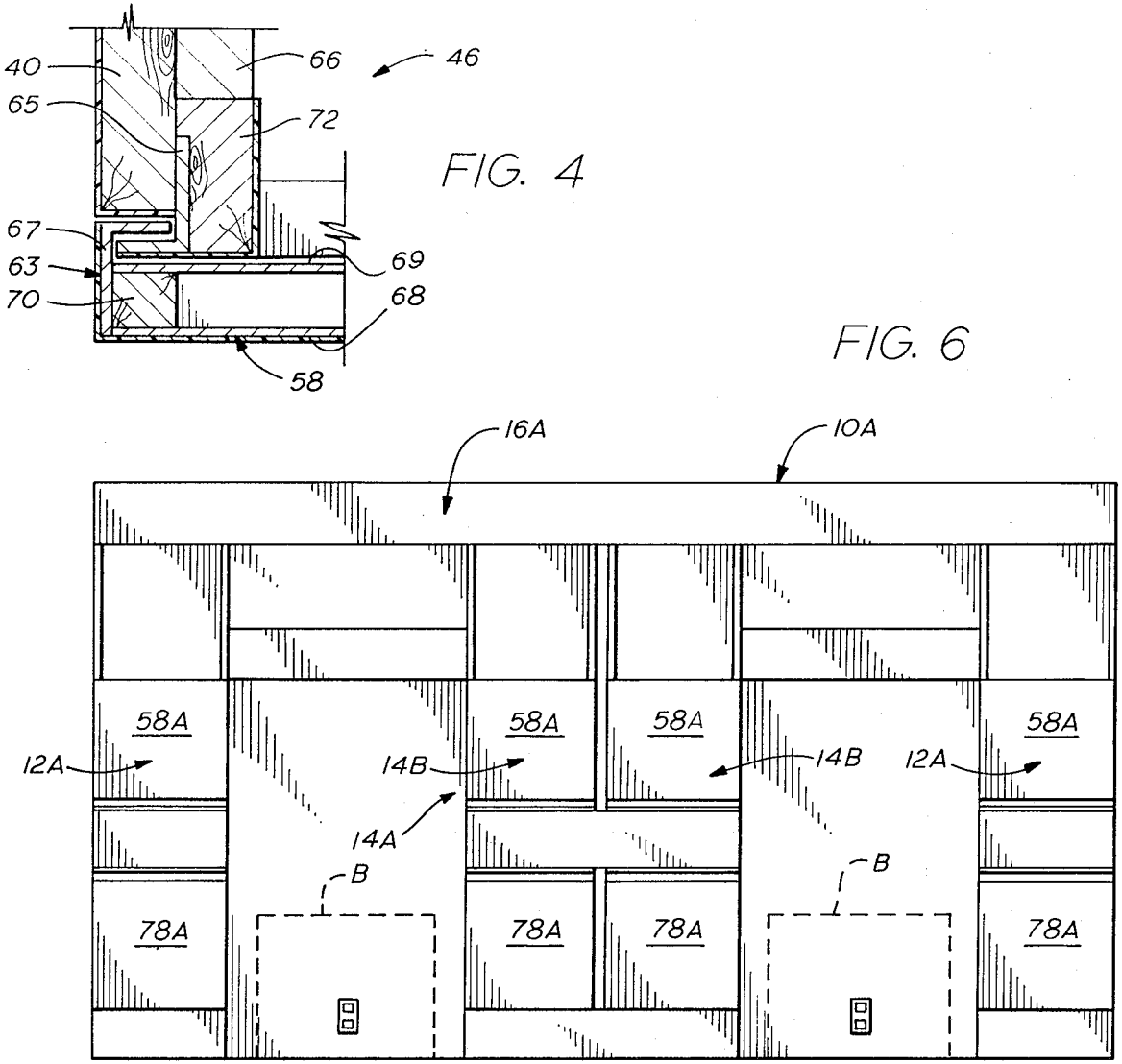
FIG. 6
FIG. 4
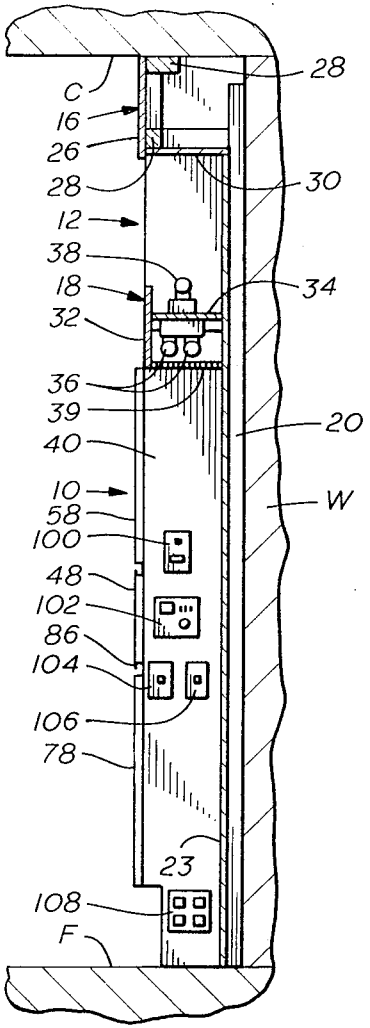
FIG. 5

HEADWALL UNIT FOR HOSPITAL ROOMS AND THE LIKE

BACKGROUND OF THE INVENTION

This invention relates to a headwall unit for patient care rooms such as hosptial rooms of the like, and more particularly to such a headwall unit which may be secured to a vertical wall of a patient care room and extends between the floor and ceiling of the room.

Heretofore, such as shown in U.S. Pat. No. 4,338,485 dated July 6, 1982, headwall units have been provided for attachment to an existing vertical wall of a patient care room, and horizontally slidable panels have been provided to permit access to the inside of the headwall unit for maintenance and repair of the various utility lines and the like. However, the fronts of such headwall units heretofore have had several utility outlets and various switches or buttons exposed to the view of the patient even when all of the movable panels are in a closed position. Such a frontal view to a patient may be disconcerting at times. Further, such head wall units have not had adequate space for the storage or installation of blood pressure equipment or the like.

SUMMARY OF THE INVENTION

The present invention is directed to a headwall unit adapted to be attached to a vertical wall of a patient care room. The head wall unit comprises a pair of horizontally spaced side portions extending vertically from the floor and connected at their upper ends by a connecting headboard section extending horizontally between the side portions at the ceiling. The space between the side portions and beneath the headboard section is sufficient to receive the end of a bed for the patient.

Each side portion of the headwall unit is identical and includes an intermediate compartment which is covered by a slidable cover or panel. The panel is slidable vertically to an upper open position to provide access to the compartment which may be utilized for the storage or installation of blood pressure equipment or the like. Upon movement to the open upper position the movable panel uncovers a lower fixed panel on which a plurality of suitable gas and electrical outlets may be mounted, for example. Thus, in the closed portions of the slidable panel the outlets are not visible and a smooth esthetically pleasing appearance is provided to a patient and others by the headwall unit of this invention.

The compartment includes a box structure having a rear vertical panel, and opposed pairs of side panels extending outwardly from the rear panel. A lower relatively short vertical panel extends downwardly from the box structure and is inset slightly from the outer sliding panel which covers the box structure and lower panel in a closed position. The lower panel is adapted to receive suitable gas, vacuum, or electrical outlets covered by the sliding panel when not being used. The box structure is removably connected with the associated side portion and may be removed in an open position of the sliding panel to provide access to the inside of the side portion by workmen for maintenance or repair of utility lines and the like which may be housed within the side portion. Blood pressure equipment may be mounted within the box structure above the lower fixed panel.

It is an object of this invention to provide a headwall unit adapted to be attached to a vertical wall of a hospital room or the like.

A further object of the invention is to provide such a headwall unit which has a smooth esthetically pleasing frontal appearance and includes a pair of side portions spaced from each other to receive a bed therebetween.

An additional object of the invention is to provide such a headwall unit in which each of the side portions has an intermediate compartment covered by a sliding outer panel which is movable vertically to an open position for exposing a fixed panel on which a bank of outlets are provided, such as electrical or gas outlets.

Another object is to provide a removable compartment structure which may be removed to provide access behind the compartment structure to workmen for the repair or maintenance of utility lines or the like housed within the headwall unit.

Other objects, features, and advantages of this invention will become more apparent after referring to the following specifications and drawings.

DESCRIPTION OF THE INVENTION

FIG. 4 is an enlarged section taken generally along line 4—4 of FIG. 1 and showing the concealed track arrangement for the sliding panels;

FIG. 5 is a section view taken generally along line 5—5 of FIG. 1; and FIG. 6 is a front elevation of a further embodiment of the headwall unit which is adapted for use in a semiprivate hospital room or the like for receiving a pair of hospital beds.

Figure 1:
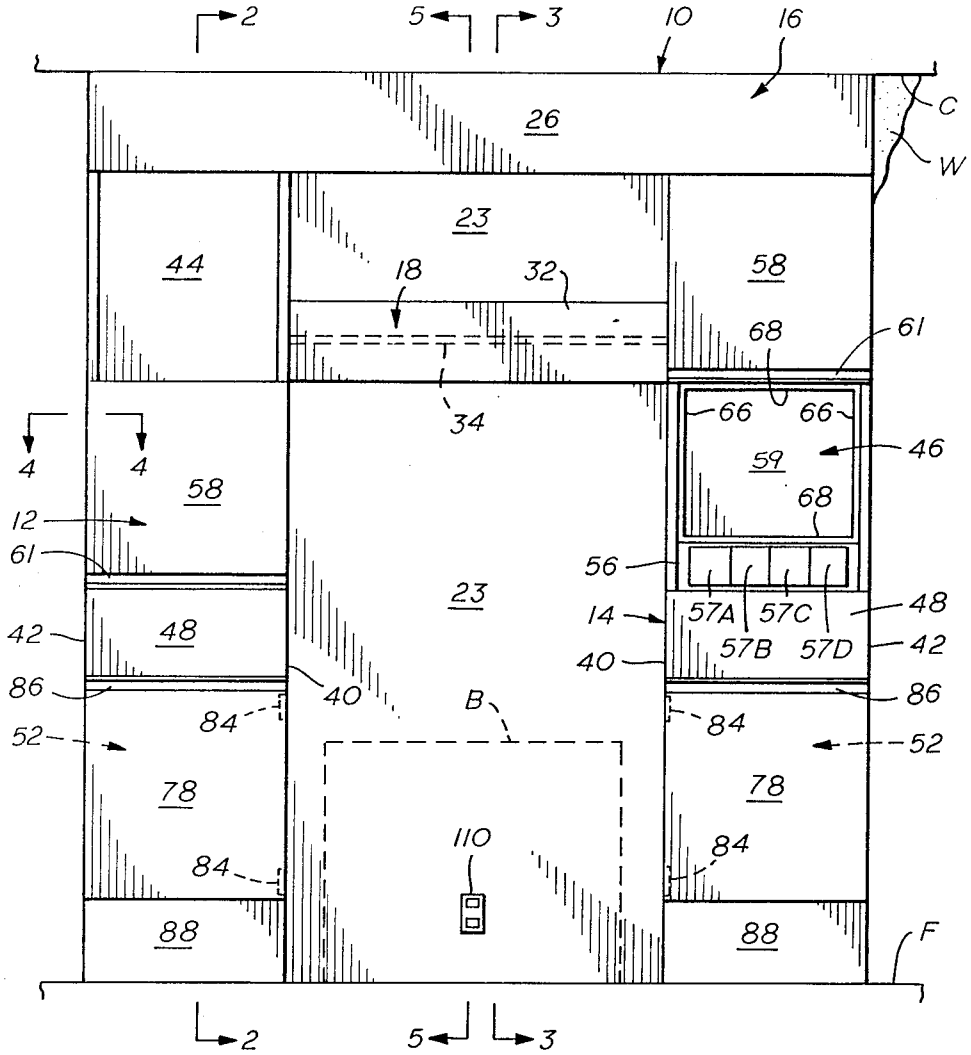
FIG. 1 is a front elevational view of the headwall unit comprising the present invention positioned within a private room of a hospital or the like and showing a pair of side portions spaced from each other sufficiently to receive a hospital bed therebetween with one side portion having a slidable panel shown in an open position to expose the inside of a compartment.

Referring now to the drawings for a better understanding of this invention and more particularly to FIG. 1, the headwall unit indicated generally at 10 is adapted for attachment to the vertical extending wall W of the hospital room as will be explained. Headwall unit 10 includes two side portions indicated generally at 12 and 14 spaced horizontally from each other a sufficient distance to permit a bed indicated in broken lines at B to be positioned there between. Headwall unit 10 extends between the floor indicated at F and the ceiling indicated at C of the hospital room. An upper connecting headboard section shown generally at 16 extends between the upper ends of side portions 12 and 14. An intermediate connecting headboard section indicated generally at 18 extends between side portions 12 and 14. It is noted as shown in FIG. 1 that no utility outlets, switches, buttons, or the like are visible from the front when compartments of side portions 12 and 14 are in a closed position.

Headwall unit 10 includes framing members 20 which are secured to the adjacent wall W by suitable fasteners 22, such as toggle stud bolts, at various intervals to provide the necessary attachment. A laminated plastic facing back panel 23 is secured to center framing members 20 and is exposed to view between side portions 12 and 14 as shown in FIG. 1.

Figure 3:
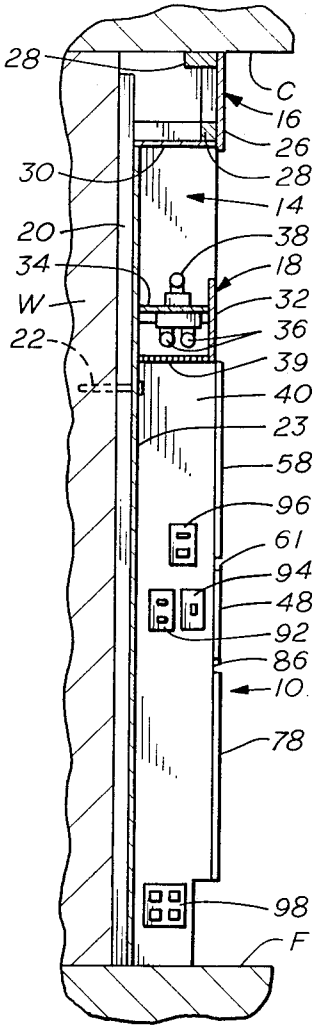
FIG. 3 is a section view taken generally along line 3—3 of FIG. 1.

Referring to FIGS. 3 and 5, upper headboard section indicated generally at 16 includes an outer front headboard 26 connected to suitable frame members 28 and a lower panel 30 extending between front headboard 26 and backboard 20.

Intermediate headboard section 18 includes a front outer panel 32 secured to horizontal support 34 extending between outer panel 32 and facing panel 23 between side portions 12 and 14 which is exposed to view. Mounted on support panel 34 are lower fluorescent lights 36 which may be used for reading and upper fluorescent light 38 which is directed in an upper direction for suitable lighting effect for television or the like. A lower grid-type plastic light diffuser panel 39 is provided for lower reading lights 36.

Each side portion 12 and 14 is identical and includes a pair of inner and outer side panels generally indicated at 40 and 42, respectively, extending between floor F and upper headboard portion 16. An upper fixed panel 44 extends between headboard 26 and an intermediate compartment indicated generally at 46. An outer intermediate panel 48 is fixed to suitable frame members 50 and extends between intermediate compartment 46 and a lower compartment generally indicated at 52.

Figure 2:
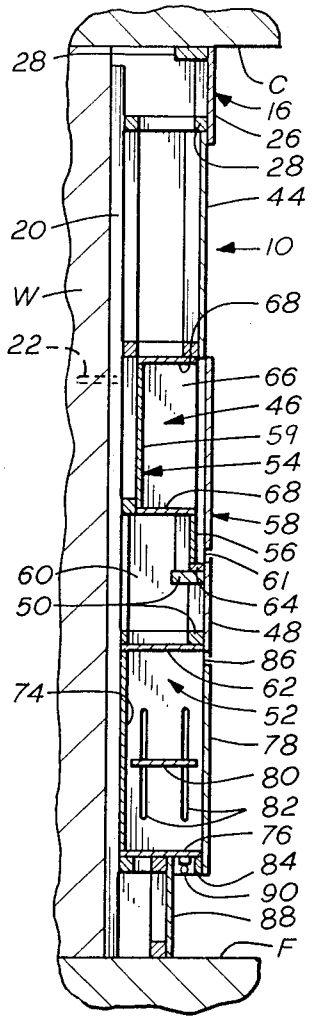
FIG. 2 is a section view taken generally along line 2—2 of FIG. 1.

Intermediate compartment 46 which forms an important part of this invention is defined by a rectangular box structure indicated generally at 54, a lower vertical support panel 56 extending downwardly from box structure 54, and an outer slidable cover or panel 58 for closing compartment 46 and covering vertical panel 56. Lower panel 56 is inset inwardly from slidable panel 58 as shown in FIG. 2 and is adapted to have a plurality of outlets or suitable receptacles 57A, 57B, 57C, and 57D thereon, such as electrical and gas outlets, for example. In the closed position of slidable panel 58, outlets 57A–57D and support panel 56 are not exposed to the view of a patient or the like. An open space 60 behind support panel 56 and fixed panel 48 may be utilized for various utility lines or support apparatus for the utility outlets 57A–57D mounted on support panel 56.

Box structure 54 includes a back 59 and opposed pairs of sides 66 and 68 extending outwardly from back 59 as shown in FIGS. 1 and 2. Lower side 68 forms a shelf on which articles may be supported for storage. Support panel 56 mounts outlets 57A–57D which may be utilized for selective outlet connections. As an example, 57A may be an outlet for oxygen, 57B may be a vacuum outlet, 57C may be a vacuum bottle bracket, and 57D may be an electrical outlet including a pair of electrical receptacles. It may only be necessary to utilize the outlets on one of the side portions 12, 14. However, if needed, the outlets 57A–57D for both side portions 12 and 14 may be utilized. Opposed sides 66 of box structure 54 may be secured by suitable screws or the like to adjacent sides 40, 42 of the associated side portion 12. Thus, upon removal of such screws, box-type structure 54 may be removed to permit workmen or the like to gain access to space 60 for maintenance or repair of utility lines or the like leading to panel 56.

A horizontal ledge 64 extends between and connects panels 48 and 56. Sliding cover or panel 58 has a lower aluminum pull strip shown at 61 for permitting manual movement of panel 58 to a raised or upper open position in lapped relation to upper fixed panel 44 as is shown on the right viewing FIG. 1. A concealed track structure shown generally at 63 on FIG. 4 is provided to permit sliding movement of panel 58. Track structure 63 includes interfitting angle-shaped track members 65, 67. Sliding panel 58 has a hollow core construction and a pair of facing panels 68 and 69 thereof are separated by a vertical frame number 70. Front panel 68 has a plastic laminated outer surface. A fixed wood frame number 72 is mounted adjacent side 40. Angle-shaped track member 67 is secured to panel 58 including frame member 70 for movement with slidable panel 58. Track member 65 is secured to side 40 and frame member 72 and is fixed. Thus, concealed track structure 63 permits slidable panel 58 to be easily lifted and moved between open and closed positions.

Lower compartment 52 may be utilized for the storage of medical supplies or the like for example, and is defined by a back 74, a lower panel 76, and an outer door or panel 78. A vertically adjustable shelf 80 is mounted for selective positioning along slots 82 by suitable brackets (not shown). Panel 78 is hinged along its inner side by self-closing hinges shown generally at 84 and has an aluminum pull strip 86 along its upper edge to permit panel 78 to be manually pivoted about hinges 84 for access to compartment 52.

A vertical extending lower support panel 88 is inset inwardly from door 78 and extends between floor F and panel 76. It is noted that door 78 extends downwardly beyond the upper marginal edge portion of panel 88 to provide a space between panel 88 and the lapping lower marginal edge portion of door 78. A night light as indicated at 90 is directed against the floor.

As shown in FIGS. 3 and 5, different outlets, buttons, or switches are provided on sides 40 of side portions 12 and 14. For side 40 on side portion 14 as shown in FIG. 3, bed light switches are shown at 92 and a night light switch is shown at 94, each with a separate cover plate. If desired, a common cover plate over a common box could be utilized for switches 92 and 94. An emergency light is shown at 96 and a lower electrical receptacle is shown at 98 which includes an emergency power duplex receptacle and a regular power duplex receptacle with a common cover plate.

As shown in FIG. 5 for side 40 of side portion 12, an emergency light is shown at 100, a nurse call is shown at 102, a telephone jack is shown at 104, an EKG jack is shown at 106, and a lower emergency electrical power receptacle is shown at 108. An additional electrical receptacle is shown in FIG. 1 at 110 mounted on center facing panel 23.

Referring to FIG. 6, another embodiment of the invention is shown which is particularly adapted for use in a semi-private room for two patients. A headwall unit is shown generally at 10A and includes two outer side portions 12A and an integral center portion 14A which contains two connected inner portions 14B. Outer side portions 12A are spaced from center portion 14A a sufficient distance to provide space for a two beds B. A headboard structure 16A extends between side portions 12A and center portion 14A. Center portion 14A includes two connected inner portions 14B which are similar to side portions 12A. Portions 12A and 14B are substantially identical to side portions 12 and 14 in the embodiment shown in FIGS. 1–5. Slidable panels or doors 58A and hinged panels or doors 78A are similar to doors 58 and 78 in the embodiment of FIGS. 1–5.

Thus, the headwall unit comprising the present invention is arranged so that an esthetically pleasing appearance is provided to a patient or to others in the hospital room as no outlets, buttons, or switches are visible from the front of the headwall unit when the doors or panels are closed. The sliding doors are mounted on concealed tracks and upon movement to an open position, suitable outlets mounted on fixed inner panels which are covered by the doors, such as gas or electrical outlets, are exposed for use.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A headwall unit adapted to be attached to the vertical wall of a hospital room or the like and extending between the ceiling and the floor of the hospital room; said headwall unit comprising:

a pair of side portions spaced horizontally from each other a sufficient distance to receive a bed therebetween, each of the side portions having an intermediate compartment including a generally rectangular box and a vertically slidable cover mounted over said box adapted for sliding movement between open and closed positions relative to the box;

interfitting slidable members on said sliding cover and associated side portion to permit the sliding cover to be moved between an open upper position to permit access to the box and a lower position closing access to the box;

a back panel extending between and secured to said side portions for spacing said side portions and adapted to be secured to said vertical wall for attachment of said headwall unit, said back panel being exposed to view between said side portions; and an upper front headboard extending between the upper ends of said side portions.

2. A headwall unit as set forth in claim 1 wherein an outer fixed panel is positioned above said compartment but is offset inwardly of said sliding cover to form a recess to receive said sliding cover in lapped position when the sliding cover is moved to open position.

3. The headwall unit as set forth in claim 1 wherein said intermediate compartment includes a lower front panel extending downwardly from said box to the lower marginal edge portion of said cover in closed position thereof and spaced inwardly from said cover in parallel relation thereto, the lower front panel adapted to receive a plurality of outlets for connection to suitable electric and gas sources.

4. The headwall unit as set forth in claim 1 wherein said box is defined by a rear panel extending in a vertically parallel relation to the sliding cover, and opposed pairs of sides extending perpendicularly outwardly from the rear panel between the rear panel and the cover.

5. The headwall unit as set forth in claim 1 wherein a lower compartment is provided beneath said intermediate compartment; and a hinged door is mounted over said lower compartment to provide access thereto whereby suitable medical supplies or the like may be stored therein.

6. The headwall unit as set forth in claim 5 wherein said lower compartment has a vertically adjustable shelf therein mounted for relative vertical movement to desired vertical positions.

7. A headwall unit adapted to be attached to a vertical wall extending between the ceiling and the floor of a hospital room or the like, said headwall unit comprising:

an elongate vertically extending portion including a generally rectangular compartment having an upper box structure and a subjacent lower fixed vertical support panel extending downwardly from the box structure, said box structure including a rear panel and opposed pairs of side panels extending perpendicularly outwardly from the rear panel to provide an open space for the storage of desired articles;

a vertically slidable front panel over the compartment to permit access to the box structure and lower support panel; and means mounting said slidable panel for sliding movement between an open upper position to permit access to the compartment and a closed lower position closing access to the compartment, said slidable panel in closed position being in closely spaced overlapping relation with said lwoer support panel for covering said support panel;

said lower front support panel adapted to receive a plurality of outlets therein for connection to suitable electric and gas sources, and being covered by said slidable panel in the closed position thereof.

8. The headwall unit as set forth in claim 7 wherein said compartment is defined between a pair of sides extending vertically from the floor of the hospital room with one of said sides adapted to be positioned adjacent the bed of a patient, said one side having a plurality of separate outlets thereon including a bed light switch, a nurse call panel, and electrical receptacles.

9. The headwall unit as set forth in claim 7 wherein the headwall unit includes a pair of side portions horizontally spaced from each other a sufficient distance to receive a bed therebetween and each of said headwall units including a compartment.

10. The headwall unit as set forth in claim 9 wherein said headwall unit is adapted for use with a semi-private hospital room and includes a pair of outer side portions and a center portion between the outer side portions;

each of said outer side portions being spaced from said center portion a sufficient distance to receive a bed therebetween;

and each of said side portions and said center portion having a compartment therein.

11. A headwall unit adapted to be attached to a vertical wall extending between the ceiling and the floor of a hospital room or the like, said headwall unit comprising:

an elongate vertically extending portion including a generally rectangular compartment having a box structure and a lower fixed vertical support panel extending downwardly from the box structure, said box structure including a rear panel and opposed pairs of side panels extending perpendicularly outwardly from the rear panel to provide an open space for the storage of desired articles;

a vertically extending outer panel over the compartment offset outwardly from and in generally parallel closely spaced overlapping relation to said vertical support panel;

means mounting said outer panel for movement between an open position to permit access to the compartment and a closed lower position closing access to the compartment;

said lower front support panel adapted to receive a plurality of outlets therein for connection to suitable electric and gas sources, said outer panel covering said support panel in the closed position thereof and permitting access thereto in the open position thereof; and a pair of spaced opposed parallel sides on said elongate portion extending vertically from the floor of the hospital room with one of said sides adapted to be positioned adjacent the bed of a patient, said one side having a plurality of separate outlets thereon accessible to the patient.

12. A headwall unit adapted to be attached to the vertical wall of a hospital room or the like and extending between the ceiling and the floor of the hospital room; said headwall unit comprising:

a pair of side portions spaced horizontally from each other a sufficient distance to receive a bed therebetween, each of the side portions having an intermediate compartment including a generally rectangular box and a vertically extending front cover mounted over said box;

means mounting said front cover for movement between an open position to permit access to the box and a closed position closing access to the box;

said intermediate compartment including a lower front panel extending downwardly from said box to the lower marginal edge portion of said cover in closed position thereof and spaced inwardly from said cover in parallel relation thereto, said lower panel being covered by said cover in its closed position and being uncovered for access thereto in the open position of said cover, the lower front panel extending across substantially the entire width of the associated side portion and adapted to receive a plurality of outlets for connection to suitable electric and gas sources;

a back panel extending between and secured to said side portions for spacing said side portions and adapted to be secured to said vertical wall for attachment of said headwall unit, said back panel being exposed to view between said side portions; and a front headboard extending between said side portions and adapted to receive a lighting fixture therein.

13. A headwall unit adapted to be attached to the vertical wall of a hospital room or the like, said headwall unit comprising:

a pair of generally parallel elongate side portions spaced horizontally from each other and adapted to extend between the ceiling and floor of the hospital room;

a back panel extending between and secured to said side portions a distance sufficient to receive a bed therebetween;

an upper front headboard extending between and secured to the upper ends of said side portions;

an intermediate front headboard secured between said side portions and adapted to receive a lighting fixture concealed from a frontal view;

each side portion having an intermediate compartment and a lower subjacent compartment, each compartment extending for the entire width of the associated side portion; and a separate closure for each of the compartments movable between an open position permitting access to the associated compartment and a closed position covering the compartment, said compartments adapted to receive articles therein for storage.

14. A headwall unit as set forth in claim 13 wherein said intermediate compartment includes an upper box structure and a lower fixed vertical support panel extending downwardly from the box structure adapted to receive a plurality of outlets therein for connection to suitable electric and gas sources; and said closure for said intermediate compartment comprises a slidable outer panel mounted for movement between an open position to permit access to said intermediate compartment and a closed position blocking access to said intermediate compartment including said lower support panel.

15. A headwall unit set forth in claim 14 wherein means mount said slidable outer panel for sliding vertical movement between open and closed positions, said means including a concealed vertically extending track structure adjacent opposite sides of said outer panel, said track structure including interfitting track members on said slidable panel and said associated side portion.

* * * * *